US008790572B2

(12) United States Patent
Stone et al.

(10) Patent No.: US 8,790,572 B2
(45) Date of Patent: Jul. 29, 2014

(54) TITANIUM FLAT PRODUCT PRODUCTION

(75) Inventors: Nigel Austin Stone, Victoria (AU); Robert Wilson, Victoria (AU); Merchant Yousuff, Victoria (AU); Mark Gibson, Victoria (AU)

(73) Assignee: Commonwealth Scientific and Industrial Research Organisation, Campbell, Australlan Capital Territory ( * ) Notice: Subject to any disclaimer, the term of this patent is extended or adjusted under 35 U.S.C. 154(b) by 1044 days.

(21) Appl. No.: 12/450,662

(22) PCT Filed: Apr. 4, 2008

(86) PCT No.: PCT/AU2008/000482

§ 371 (c)(1),
(2), (4) Date: Mar. 22, 2010

(87) PCT Pub. No.: WO2008/122075

PCT Pub. Date: Oct. 16, 2008

(65) Prior Publication Data

US 2010/0183470 A1 Jul. 22, 2010

(30) Foreign Application Priority Data

Apr. 4, 2007 (AU) ..... 2007201490

(51) Int. Cl.
*B22F 1/00* (2006.01)
*B22F 1/02* (2006.01)

(52) U.S. Cl.
USPC ..... 419/43; 419/28; 75/245

(58) Field of Classification Search
USPC ..... 419/43, 28; 75/245

IPC ..... B22F 2998/10,2998/00, 3/18; C22C 1/0491
See application file for complete search history.

(56) References Cited

U.S. PATENT DOCUMENTS

| | | | | |
|---|---|---|---|---|
| 3,472,705 | A | 10/1969 | Gregory et al. | |
| 3,530,210 | A * | 9/1970 | Patton | 419/69 |
| 4,432,795 | A | 2/1984 | Andersen | |
| 4,594,217 | A | 6/1986 | Samal | |
| 4,670,214 | A * | 6/1987 | Magnuson et al. | 427/123 |
| 4,917,858 | A * | 4/1990 | Eylon et al. | 419/28 |

(Continued)

FOREIGN PATENT DOCUMENTS

| | | |
|---|---|---|
| GB | 2107735 A | 5/1983 |
| GB | 2112021 | 7/1983 |
| GB | 8763989 | 3/1991 |

OTHER PUBLICATIONS

International Search Report dated May 16, 2008.

(Continued)

*Primary Examiner* — Weiping Zhu
(74) *Attorney, Agent, or Firm* — Jacobson Holman, PLLC.

(57) ABSTRACT

Titanium flat product is produced by passing a titanium powder green flat material through a pre-heating station and heated under a protective atmosphere to a temperature at least sufficient for hot rolling. The pre-heated flat material then is passed through a rolling station while still under a protective atmosphere and hot rolled to produce a hot rolled flat product of a required level of hot densification. The hot rolled flat product is passed through a cooling station while still under a protective atmosphere, and cooled to a temperature at which it can be passed out of a protective atmosphere. In the process, the hot rolling provides the predominant hot densification mechanism involved.

18 Claims, 7 Drawing Sheets

(56) References Cited

U.S. PATENT DOCUMENTS

| | | | |
|---|---|---|---|
| 2004/0016478 | A1 | 1/2004 | Sharpe et al. |
| 2004/0096350 | A1 | 5/2004 | Moxson et al. |
| 2006/0147333 | A1 | 7/2006 | Moxson et al. |

OTHER PUBLICATIONS

Lou et al., Microwave sintering of titanium, Key Engineering Materials, vol. 436 (2010) pp. 141-147.
Cantin et al., Innovative Construction of Titanium & Titanium Alloy Poeders by Direct Rolling, PM2010 World Congress-Ti Alloys & Ti Based Compositions, pp. 1-7.
Cantin et al., Innovative Construction of Titanium & Titanium Alloy Poeders by Direct Rolling, Powder Metallurgy, vol. 54, No. 3 (2011), pp. 188-192.
Qian, Cold Compaction & Sintering of Titanium & ITs Alloys for Near-Net-Shape or Preform Fabrication, vol. 46, Issue 5, 2010, pp. 29-44.
Froes, Innovations in Titanium technology, Materials Technology, 2007, vol. 22, No. 2, pp. 101-104.
Peter, et al., Titanium Sheet Fabricated from Powder for Industria Applications, JOM, vol. 64, No. 5, 2012, pp. 566-573.
Stone et al., Influence of Titanium Powder Source and Processing Conditions on theSMicrostructure/Mechanical Proper, a PowerPoint presentation and its Abstract, 2012, 1-17.
Stone et al. "A Continuous Process for Production of CP Titanium Sheet by Direct Powder Processing", 2008, pp. 1-11.
Udomphol, Power Rolling, A slide is from a PowerPoint presentation for a lecture of 2007, Sunawaree University of Technology, Thailand.

* cited by examiner

TITANIUM FLAT PRODUCT PRODUCTION

This is a national stage of PCT/AU08/000482 filed Apr. 4, 2008 and published in English, which has a priority of Australian no. 2007201490 filed Apr. 4, 2007 and claiming benefit of U.S. provisional No. 60/907,491, filed Apr. 4, 2007, hereby incorporated by reference.

FIELD OF THE INVENTION

This invention relates to the production of titanium flat product, such as strip or plate, involving densification of green flat material of titanium powder.

BACKGROUND TO THE INVENTION

Roll compaction to produce strip currently is applied to powders of a range of metals and their alloys. These metals include steel, stainless steel, iron-silicon, cobalt-iron, copper, nickel, chromium, aluminium and titanium. Current roll compaction involves consolidation of metal powder, which may be elemental, blended elemental (BE) or pre-alloyed (PA) powder, by a standard rolling mill to produce a "green" strip. By a batch or continuous operation, the green strip undergoes further sintering and re-rolling, to produce a flat strip product with a tailored degree of porosity or fully dense sheet.

Direct powder rolling technology has a number of advantages over the conventional ingot/wrought processing route to sheet production. These advantages include:

(a) lower operating costs and also lower capital equipment requirements by minimising the number of processing steps;

(b) production of high purity sheet with minimal risk of segregation and at a higher yield;

(c) facilitating production of fine-grained, high strength strip exhibiting a lower effect of rolling orientation on mechanical properties and grain texture; and (d) facilitating production of specialty materials difficult to produce by more conventional means, such as strip which is bimetallic, porous, composite bearing, functionally graded and/or clad, as well as strip of those alloys that are not readily amenable to hot and/or cold working.

There are three powder processing routes that have most widely been used. These differ in the preparation of the green strip. In the first route, the powder is mixed with a binder prior to the powder/binder mix being subjected to roll compaction. In the second and third routes, dry powder without binder is subjected to roll compaction, at ambient or an elevated temperature, respectively. With each of the three routes, the green strip is sequentially sintered for an extended period to a high density, and then subjected to hot and/or cold rolling. After hot rolling the green strip, the resultant densified strip may be cold rolled prior to being annealed or annealed prior to being cold rolled. After initial cold rolling of the densified strip, the resultant cold rolled strip may be subjected to further sintering and cold rolling, prior to being annealed.

The use of a binder, as in the first of those routes, is not desirable as it results in the end product metal strip containing inclusions which diminish physical properties. Thus, the second and third routes have been preferred for the production of strip of various metal powders, including titanium and titanium alloy strip. The procedures of these routes are illustrated by British patent specifications GB 2107738A and GB 2112021A, both by Imperial Clevite Inc, U.S. Pat. No. 4,594,217 to Samal, U.S. Pat. No. 4,917,858 to Eylon et al, and US patent publication US 2006/0147333A1 by Moxson et al.

The process of GB 2107738A involves passing a powder mixture of an enriched metal alloy and a filler metal through a powder rolling mill to produce a densified mass having a density of at least 80% theoretical, and sintering the densified mass to cause interparticle bonding and diffusion to produce a homogeneous mass. The filler metal may be titanium or a titanium alloy, while the alloy may contain aluminium, zinc, magnesium and copper. The process of GB 2112021A differs from that of GB 2107738A principally in that the initially formed densified mass can have a density as low as 50% of the theoretical density, and it is cold rolled prior to sintering.

U.S. Pat. No. 4,594,217 relates to direct powder rolling of dispersion strengthened copper, iron, nickel or silver and its process is relevant to titanium only in that titanium oxide is one of various refractory oxides that may be used to achieve dispersion strengthening. The powder rolling is to produce green strip with a density of from 90% to 95% of theoretical, and the green strip is sintered in an inert atmosphere and for a period of time to cause the particles to adhere and form a solid body which then is subjected to at least one cycle of cold rolling and re-sintering.

U.S. Pat. No. 4,917,858 is specific to production of titanium aluminide foil, of either $Ti_3Al$ or TiAl. Blended elemental powders, which may contain minor alloying additions, are rolled to produce green foil, after which the foil is sintered, such as to a density of from 88% to 98% of the theoretical density, and then subjected to a suitable form of hot pressing, such as by vacuum hot pressing, hot isostatic pressing, hot rolling or hot die forging.

US patent publication US 2006/0147333 relates to a process for the production of sheet, and other flat products, of titanium. In this, a green strip is produced by passing powder through a first set of unequally sized rolls, and then through a second set of larger rolls. The strip from the first set of rolls is to achieve a density of 40 to 80% of the theoretical density and, due to the rolls of that set being unequally sized, the strip is bent so as to pass to the second set. The rolls of one of the two sets are rotated relative to each other to achieve densification by shear deformation. The strip from the second set of rolls is subjected to multiple stages of cold re-rolling, said to achieve about 100% of the theoretical density, after which the strip is sintered under vacuum or a protective atmosphere. The powder mix used is a mix of CP titanium matrix powder and an alloying powder having a particle size at least ten times smaller than the matrix powder, to produce, for example, fully dense Ti-6Al-4V alloy.

While titanium strip can be produced by processes such as detailed above, there remains a problem which also applies to titanium strip produced by the ingot/wrought processing route. This arises with that cost component, of the overall cost of producing the sheet, attributable to the production of titanium metal, whether as powder or ingots, respectively. Relative to the production of strip of other metals, the metal production cost component for titanium strip is very high. Thus, until a more cost efficient process is developed for the production of titanium metal, it is necessary to seek cost reducing efficiencies at all production stages in order to increase the competitiveness of titanium strip with respect to strip of other metals.

The present invention seeks to provide an alternative process for the production of titanium flat product, such as strip or plate, which involves densification of green flat material of titanium powder and which, at least in some forms, enables more cost effective production.

SUMMARY OF THE INVENTION

The present invention provides a process for the production of titanium flat product. In the case of strip, the flat product may be sufficiently thin to comprise "foil", the term used in the above-mentioned U.S. Pat. No. 4,917,858. However, in U.S. Pat. No. 4,917,858, the foil is indicated as being from 0.1 to 10 mm thick, whereas more generally foil usually is less than 0.1 mm thick, such as about 0.02 mm thick in the case of aluminium foil. The strip produced by the present invention may have a final thickness within the range of 0.1 to 10 mm, but the thickness usually is less than about 5 mm, preferably less than 2 mm, and can be varied to suit a particular application for the strip. Where the flat product is in the form of plate, the thickness may range from about 3 mm up to about 10 mm.

The present invention provides a process for producing titanium flat product which includes the steps of:

(a) passing a titanium powder green flat material through a pre-heating station in which the flat material is heated under a protective atmosphere to a temperature at least sufficient for hot rolling, (b) passing pre-heated flat material from the pre-heating station to and through a rolling station while still under a protective atmosphere and hot rolling the pre-heated product to produce a hot rolled flat product of a required level of hot densification; and (c) passing the hot rolled flat product from the hot rolling station, to and through a cooling station while still under a protective atmosphere, and cooling the hot rolled flat product to a temperature at which it can be passed out of a protective atmosphere;

wherein hot rolling in step (b) is the predominant hot densification mechanism involved in the process.

In the process of the invention, the titanium flat material is produced from a titanium containing powder. The powder may comprise a single, substantially homogeneous material, such as CP titanium or a suitable titanium alloy. Alternatively, the powder may be a blend of at least two different materials. In the latter case, the materials may differ in physical form, such as in the case of a bimodal particle size blend. Alternatively or additionally, the materials may differ compositionally, such as in being a blend of CP titanium or titanium alloy powder with powder of alloying elements or of another titanium alloy, or such as an inter-metallic compound. The invention is particularly useful for powders of compositions which, in a wrought condition, are prone to segregation, as it provides a route to the production of fully densified product substantially free of segregation.

The process of the present invention is a marked departure from previous proposals for hot densification of green titanium powder flat material by sintering. In those previous proposals sintering normally is conducted as a batch operation in which a bulk quantity of the material, as coiled strip or a stack of plates, is slowly brought up to a sintering temperature over a period of time, such as about two hours, and then held at temperature under a protective atmosphere for a substantial period, usually in excess of 1.5 to 2 hours, to produce a sintered product. The sintered product then is cooled to ambient temperature and stored until it then is cold and/or hot rolled. The predominant hot densification mechanism involved is solid-solid diffusion characterising the sintering step, with the subsequent cold and/or hot rolling essentially being a sizing operation. During the long heating to the sintering temperature, the holding at that temperature for sintering and, where used, the subsequent pre-heating and hot rolling, the titanium bulk quantity needs to be maintained under a vacuum or protective atmosphere. In a closed batch system a vacuum or static protective atmosphere may be used with the titanium bulk quantity at an elevated temperature without an undesirably large aggregate exposure to residual oxygen and nitrogen.

To convert to a continuous processing arrangement, the protective atmosphere needs to be at a positive pressure, with fresh gas being supplied to maintain the atmosphere. Over the similarly prolonged periods at which the titanium bulk material would need to be at an elevated temperature to achieve a suitable density, there is an undesirably large aggregate exposure of the material to residual oxygen and nitrogen in the fresh gas and, hence, a risk of the material being contaminated.

In the process of the present invention, the overall treatment time is very short. Thus, while it is necessary to use a protective atmosphere at a positive pressure, the risk of exposure to contaminants in fresh gas to maintain the atmosphere is very substantially reduced. Also, because of the very short treatment time, the rate of production of titanium flat product is relatively high, while product inventories can be kept low, thereby substantially reducing the cost of production. Moreover, relative to wrought product, there is a major cost reduction due to the short heating time required with the invention.

The successive steps in the present invention of pre-heating, hot rolling and cooling preferably are conducted on a continuous basis, rather than batchwise. With continuous operation, that which initially is the green flat material and which becomes the hot rolled flat product, is able to pass continuously through the successive stations, essentially at a speed suitable for hot rolling. However, where pre-heating and hot rolling follow continuously after direct powder rolling of green strip, the initial green strip compaction rate generally will set the through-put rate. The time at an elevated temperature can vary with the thickness and density of the green flat material but, despite this, the time at an elevated temperature usually is substantially less than about 10 minutes, and preferably less than about 5 minutes. For green material comprising relatively thin titanium powder green strip, the time at elevated temperature can be less than 2 minutes. These times are very short relative to the periods of exposure in the previous sintering proposals.

The hot rolling is conducted to achieve a substantial thickness reduction, in order to achieve substantial densification. Most preferably, the thickness reduction is at least 50%, such as at least 55%. Also, particularly with thinner green flat material, the thickness reduction preferably is achieved in a single pass. However, in an alternative arrangement, the hot rolling station for step (b) is a first hot rolling station which is followed by at least a second hot rolling station, with the overall thickness reduction of at least 50% achieved as the aggregate of reduction in the successive hot rolling stations. Thus, there may for example be a thickness reduction of 30% to 40% achieved in the first hot rolling station, with the balance of the thickness reduction to the required level of hot densification being achieved in the second hot rolling station.

At least with thicker green flat material, the hot rolled flat product from the first hot rolling station may still be at a sufficient temperature for hot rolling at the second hot rolling station. However, considerable heat energy can be lost from that product in being hot rolled in the first station and in passing to the second station. Thus, it can be necessary, as is preferred, to provide a re-heating station, between the first and second hot rolling stations, through which the product from the first hot rolling station passes to be reheated to a temperature at least sufficient for hot rolling in the second hot rolling station.

As in steps (a) and (b) as detailed above, the product is reheated in the re-heating station and re-rolled in the second hot rolling station while still under a protective atmosphere.

The cooled hot rolled product from step (c) may subsequently be subjected to further processing. It may be cold rolled, subjected to further hot rolling and/or annealed after step (c) or before or after cold rolling and/or further hot rolling.

Where the green material is titanium powder green strip, the movement through the successive stations preferably is by it being drawn by rolls which perform the hot rolling step. Where the green material is green plate, successive plates may be passed through the pre-heating station and presented to the hot rolls by means of a belt, roller or other suitable conveyor, while a similar conveyor can pass the hot rolled product from the hot rolls and through the cooling station.

The process of the invention may include preparation of the green flat material. That preparation may be by direct powder rolling of the titanium powder to consolidate the powder and produce flat material comprising self-supporting green strip. Alternatively, particularly where the flat material is to be relatively thick such as from about 5 mm to 10 mm, the flat material may be in the form of self-supporting plate produced by consolidating the titanium powder by pressing. In each case, the flat material may be produced using titanium powder at an ambient temperature. However, in order to improve the flow characteristics of the powder, it may initially be conditioned to remove moisture, such as by heating to a temperature of from about 40° to 80° C. Where the powder is so conditioned, it may be rolled or pressed to produce the green flat material prior to cooling to ambient temperature.

The green flat material may be produced and passed continuously to the pre-heating station, in an overall continuous process. This is preferred where the flat material comprises self-supporting strip. The strip, as produced, may pass directly to the pre-heating station without the need to be coiled until required for further processing, thereby minimising handling of the strip and the risk of the strip being damaged such as by cracking. However, the green flat material, whether comprising either strip or plate, can be produced in a batch operation and stored or held until required for further processing.

The successive steps in the present invention of preheating, hot rolling and cooling preferably are conducted at successive stations which are spaced within a single housing. The protective atmosphere required at each station is then provided by protective gas being supplied to the housing to maintain a slight over-pressure within the housing. The protective gas, such as argon, preferably is supplied to the housing at two or more locations enabling generation, with respect to the direction of advance through the housing, of a counter-current flow of protective gas through the pre-heating station and a co-current flow of the gas through the cooling station.

In the process of the invention, the titanium powder green flat material most preferably is brought to temperature in the pre-heating step, and in any re-heating step between successive hot rolling stations, by rapid heating. This is to enable the period of time over which the flat material is at an elevated temperature to be kept to a minimum, thereby minimising both the rate of consumption of protective gas and the risk of the titanium reacting with any residual oxygen or nitrogen. Pre-heating and re-heating may be to a temperature enabling the flat material to reach the rolls for hot rolling at a suitable temperature in the range of from about 750° C. to about 1350° C. The flat material preferably is close to or above the β transus temperature (the lowest temperature for 100% β content) when hot rolled, and most preferably is from about 800° C. to 1000° C. The pre-heating preferably is by use of an induction furnace as this facilitates rapid pre-heating, while re-heating preferably is by an induction furnace for the same reason.

The pre-heated flat material most preferably is passed relatively directly from the pre-heating station to the hot rolling station. This minimises the period of time over which the flat material is exposed to elevated temperatures. It also minimises the period of time in which the temperature of the pre-heated flat material can fall, potentially to a sub-optimal temperature for hot rolling. Conversely, it minimises the period of time over which heat input between the pre-heating and hot rolling stations is required to maintain the temperature of the flat material. The same considerations apply to passing re-heated product to a second hot rolling station.

Pre-heating of the titanium powder green flat material can result in limited densification of the flat material by solid diffusion. However, as indicated, the flat material is at an elevated temperature sufficient to enable densification for a very short period of time, such as substantially less than 10 minutes, for example less than 5 minutes. Thus, there is little opportunity for densification prior to hot rolling. This essentially remains the case with re-heating and further hot rolling.

The titanium powder green flat material may have a density of from about 65% to 85%, preferably from about 75% to about 85%, of the theoretical value for fully densified material. The extent of further densification achieved in the pre-heating step, prior to the commencement of the hot rolling step, usually is substantially less than 10%, preferably is from about 2% to less than about 7%. The limited extent of that further densification is a consequence of pre-heating rapidly to the hot rolling temperature and, on attaining that temperature, advancing to the hot rolling station and hot rolling very shortly after attaining the pre-heating temperature. The rate of advance of the material and/or the spacing between the pre-heating and hot rolling stations most preferably is such that hot rolling proceeds promptly after pre-heating, with little if any practical delay.

Control over the thickness, density and uniformity of the titanium powder green flat material is of importance. It assists in achieving the required density level and required thickness by hot rolling. Control over those parameters of the green strip, where the flat material is strip from direct powder rolling, in large part is provided by control over the feeding of the titanium containing powder to the rolls of a mill system used in the powder rolling consolidating step.

In the present invention, the mill system used in the consolidating step most preferably has a single pair of horizontally adjacent rolls. The rolls preferably are of substantially the same diameter.

While the pre-heating and hot rolling of the invention are continuous, an overall process including production of the green plate or strip may be operated batchwise or continuously. With batchwise operation, the green plate or strip may be stored prior to being subjected to pre-heating and hot rolling. In the case of strip, storing may be after the strip has been cut to required lengths. With continuous operation, the green plate or strip is passed to a pre-heating station, and then to hot rolling and cooling stations. Continuous operation of course requires matching of through-put rate for a press or roll mills used, respectively, for pressing plate or direct powder rolling compaction, and with the through-put rate for hot rolling. However, this matching applies to many processes, such as those using multi-roll stand operations, and with the present invention it is facilitated by the use of a rapid pre-heating step.

In order that the invention may more readily be understood, reference now is directed to the accompanying drawings, in which.

Figure 2:
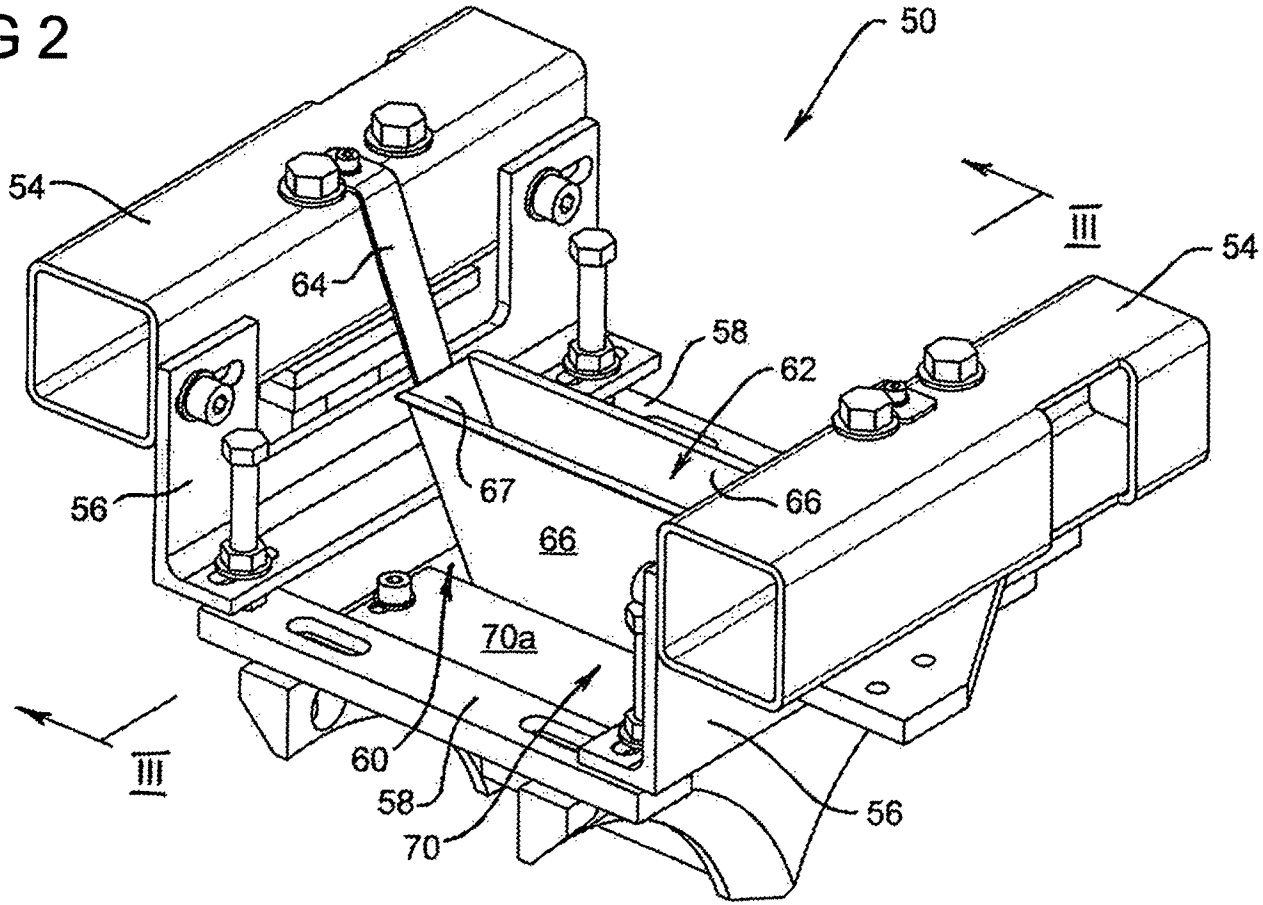
FIG. 2 is a schematic perspective view of a preferred form of powder distribution and mill system for producing titanium green strip.
Figure 3:
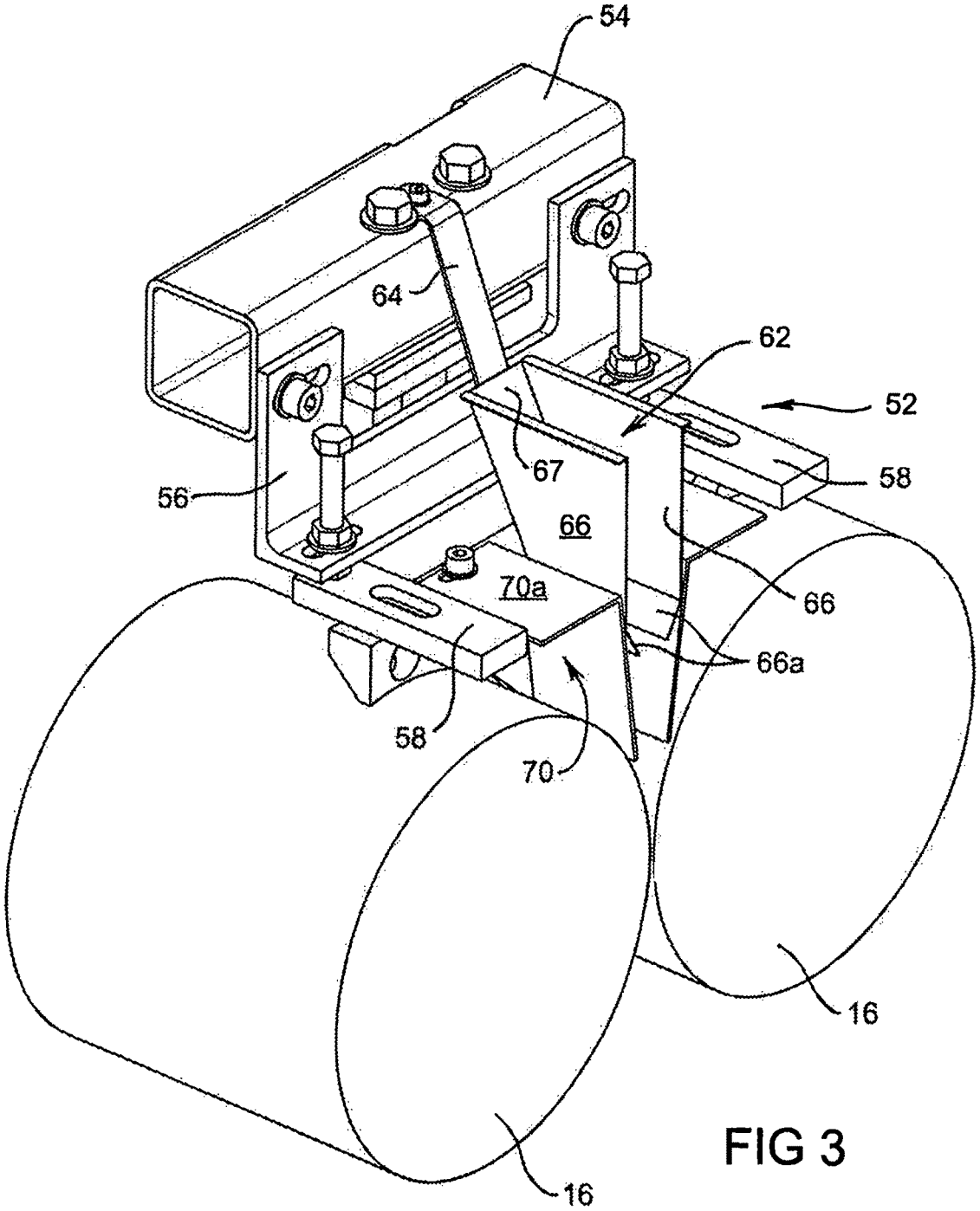
FIG. 3 is a sectional view taken on line III-III of FIG. 2.
Figure 4:
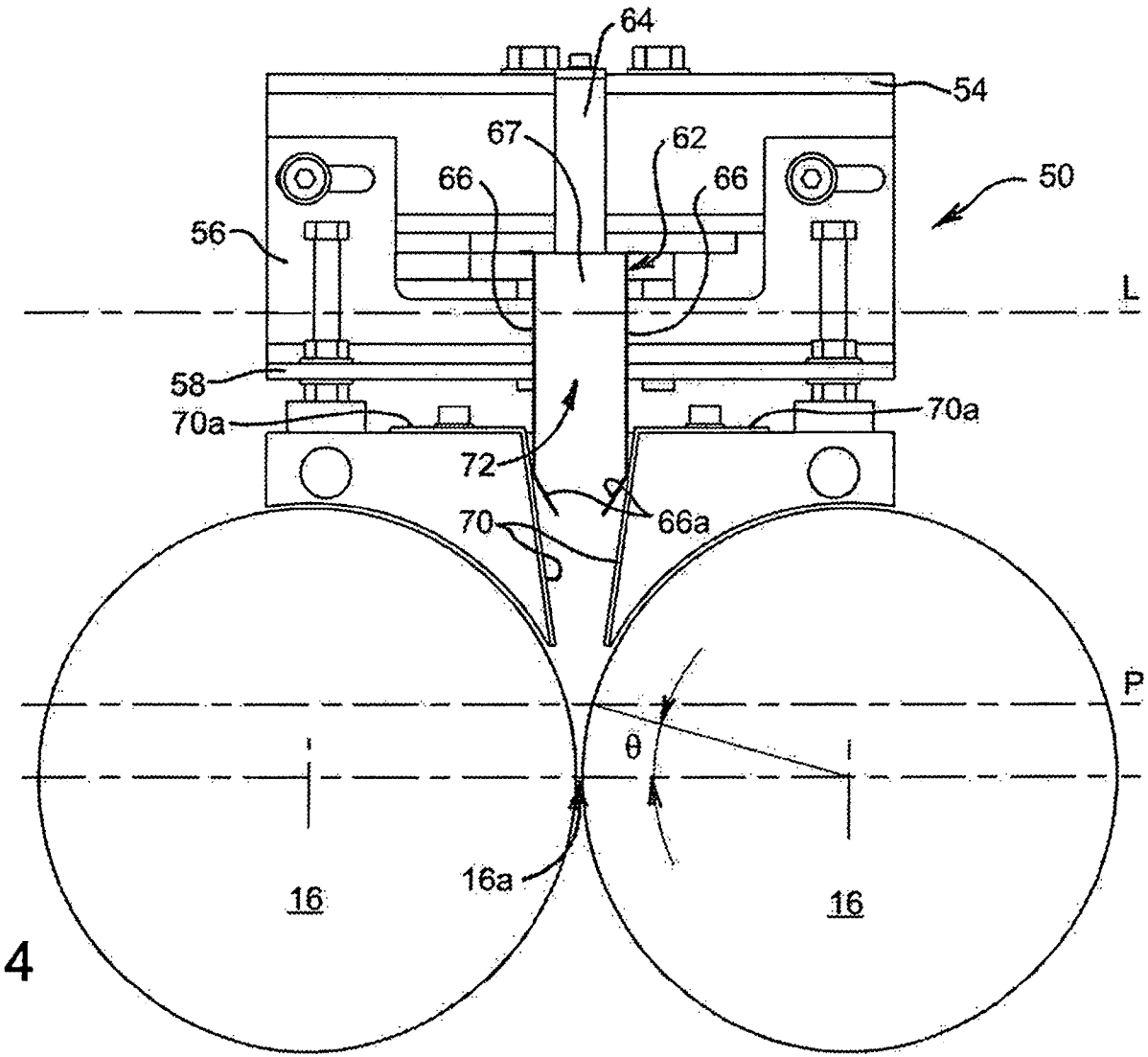
FIG. 4 shows the sectional view of FIG. 3 in elevation.
Figure 6:
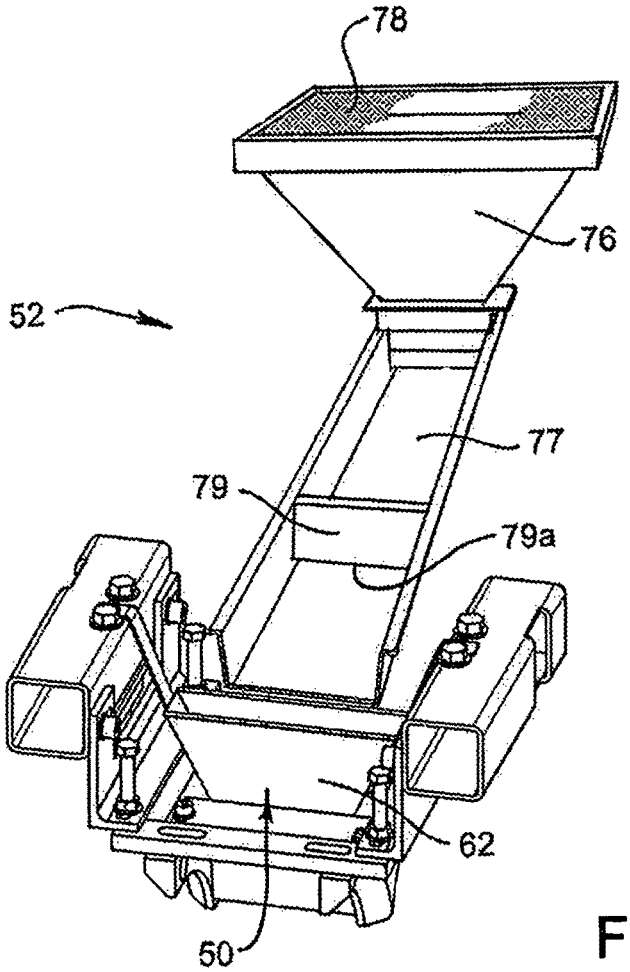
Figure 7:
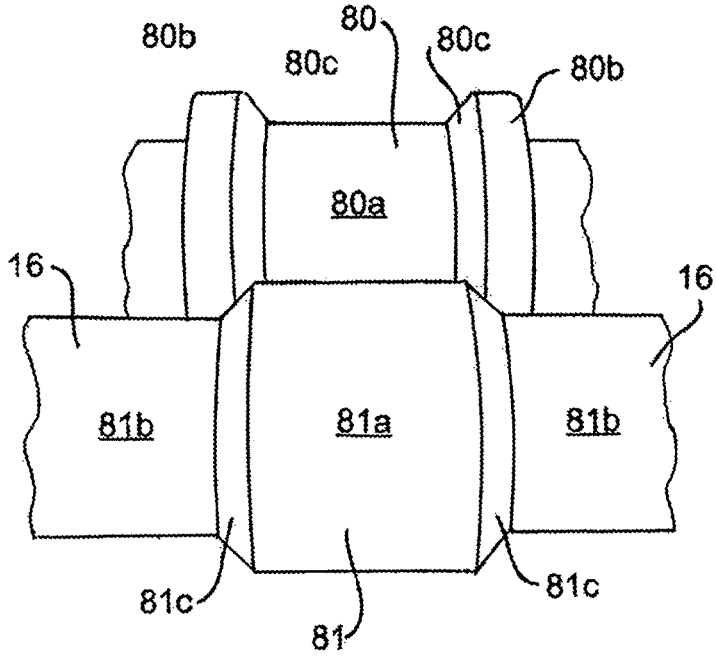

FIG. 6 schematically illustrates a powder feed system for use with the distribution and mill system of FIGS. 2 to 4; and FIG. 7 illustrates a preferred form of profiled rolls for use in preparing green strip.

Figure 1:
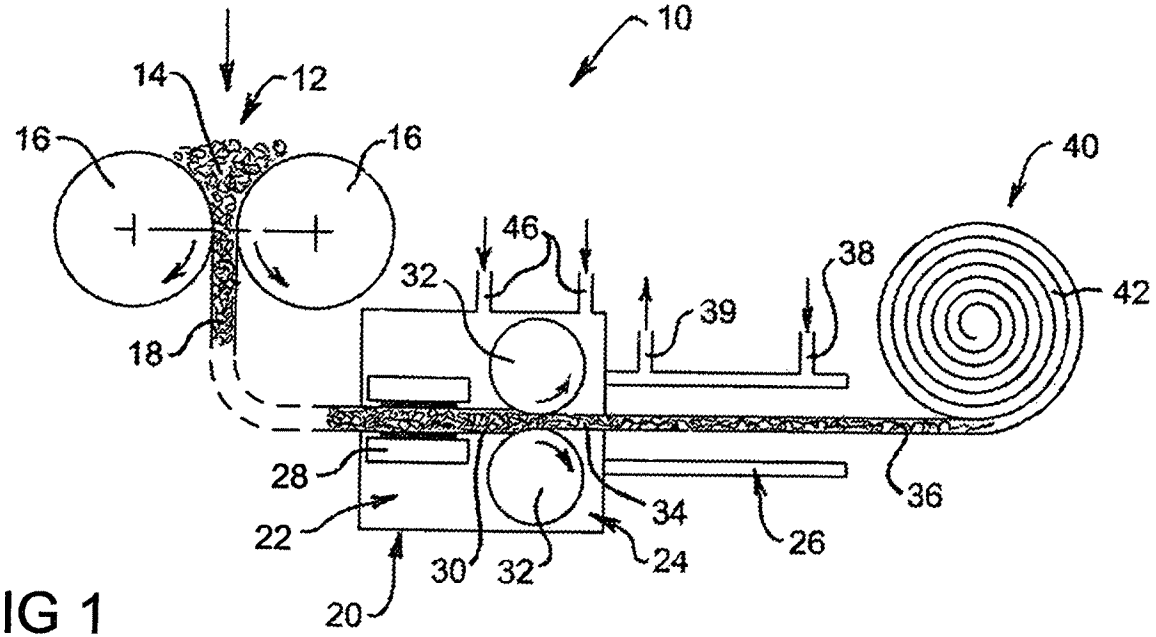
FIG. 1 is a schematic representation of one embodiment of an installation for use in producing titanium strip according to the present invention.

With reference to FIG. 1, there is shown an installation 10 for producing finished titanium strip from a titanium containing powder. Installation 10 has a green strip producing station 12 in which titanium powder 14 is subjected to direct powder rolling compaction between a pair of horizontally positioned rolls 16 to produce self-supporting green strip 18. For station 10, the powder 14 is shown as fed to the rolls 16 in a highly stylised manner, whereas a powder metering and distribution system would be required, such as shown in FIGS. 2 to 4.

The green strip 18 issues downwardly from rolls 16, vertically downwardly in the arrangement shown. This is because rolls 16 are of the same diameter and have their axes on a common horizontal plane. It is necessary for the green strip 18 to be drawn arcuately, with a sufficiently large radius of curvature which minimises the risk of damage to strip 18, until the strip is able to extend horizontally. A curved guide along which the strip 18 can be so drawn can be provided, if required, in order to further reduce the risk of damage to strip 18.

When extending horizontally, the strip 18 is able to pass through a consolidation unit 20 for further processing. The unit 20 includes a pre-heating furnace 22 and a hot rolling mill 24. The consolidation unit 20 is followed by and communicates with a cooling unit 26. The furnace 22 is an induction heater through which the green strip 18 passes and is preheated predominantly by radiation to a hot rolling temperature. The heating may be indirect, due to the heating being provided via water cooled copper coils of a graphite susceptor 28 through which the strip passes. Induction heating has the benefits of enabling rapid heating of strip 18 and also precision heating to a required hot rolling temperature.

From furnace 22 the pre-heated strip 30 passes to hot rolling mill 24 at which the pre-heated strip 30 is hot rolled by the vertically adjacent rolls 32, achieving a thickness reduction of at least 50%, such as at least 55%. Hot rolled strip 34 passes beyond mill 24 and through the cooling unit 26 provided adjacent to unit 24. In unit 26, the pre-heated and hot rolled strip 34 is able to be cooled substantially such that cooled strip 36 issuing from unit 26 is able to be exposed to the ambient atmosphere with little risk of atmospheric contamination. To provide such cooling, unit 26 is of a double-wall construction and has an inlet connector 38 and an outlet connector 39 by which cooling fluid, such as water, preferably chilled, is able to be circulated.

From unit 26, the cooled strip 36 is shown as passing to a coiling station 40. At station 40 the cooled strip 36 is wound to form coil 42, necessitating coiling on a large diameter core. The cooling achieved in unit 26 can be such that strip 36 issues at below 100° C. However, higher exit temperature can be desirable, such as from 150° C. to 400° C. The strip of coil 42 preferably is surface treated and annealed before being cold rolled for final gauging, surface finishing or to harden the strip post annealing.

As an alternative to cooled strip 36 passing to a coiling station 40, it may be cut to lengths and annealed.

The titanium powder feed to station 12 preferably has a maximum particle size of not greater than about 250 micron. Most preferably the maximum particle size is not greater than about 180 micron. The powder preferably has angular particles, such as with powder produced from titanium sponge. Prior to being supplied to station 12, the powder preferably is pre-heated to improve its flow properties. One suitable pre-treatment for this purpose involves preheating the powder to a low temperature, preferably a temperature of from about 40° C. to 80° C.

The titanium powder as supplied to station 12 may be at ambient temperature, or it may be at a low temperature as a result of the pre-treatment. In each case the powder is rolled at station 12 to provide self-supporting green strip 18 of a required thickness. Depending on the thickness required for finished hot rolled titanium strip, the green strip 18 may have a thickness of from about 10 mm to about 5 mm. The green strip preferably has a density of from about 65% to 85% of the theoretical value, such as from about 75% to 85% of that value.

In being drawn from a vertical to a horizontal plane, green strip 18 is drawn arcuately with a radius of curvature which minimises the risk of strip 18 cracking. However, the arcuate extent of strip 18 needs to be limited so that strip 18 does not crack or break under its own weight. In each case, the thickness of the strip 18 and its density will be factors influencing a choice of suitable radius of curvature. The radius may, for example, be as great as from 1 to 2 m, resulting in a length of strip 18 between stations 12 and 22 of at least about 2 to 4 m in length.

Throughout consolidation unit 20 and cooling unit 26, between the inlet to furnace 22 and the outlet from unit 26, a protective atmosphere is maintained at a slight over-pressure. That is, a common protective atmosphere prevails throughout these units 20, 26. Thus, unit 20 is provided with inlet connectors 46 by which the interior of unit 20 can receive protective gas from a suitable source (not shown). The arrangement is such that, relative to the direction in which strip is moved through unit 20, a counter-current flow of the protective gas is provided at furnace 22 and mill 24 to issue from the inlet to unit 20, while a co-current flow of the gas passes through unit 26 to issue from the outlet end.

The induction heater 22 is to heat strip 18 to ensure hot rolling at mill 24 at a suitable temperature. The temperature may be as low as about 750° C., but preferably is close to or above the β transus temperature in order that hot rolling can be conducted close to or in the fully beta-phase region and may be as high as 1350° C. The more preferred temperature range is from about 800° C. to about 1300° C., such as 900° C. to 1000° C. At such elevated temperatures, titanium is very reactive and it is highly desirable to minimise the time at which the strip is at an elevated temperature in order to minimise its exposure to any residual oxygen remaining in unit 20 or introduced at contaminant levels in the gas providing the protective atmosphere in unit 20. For this, it is desirable that heater 22 operates to raise the strip rapidly to the required temperature. Also, it is desirable that the spacing between heater 22 and rolling mill 24 is short such that the residence time of the strip in being heated in furnace 22, in passing from furnace 22 to mill 24 and in being hot rolled in mill 24, is kept to a minimum. With use of the present invention in a commercial plant, such residence time is able to be less than 10 minutes, but preferably is less than 5 minutes, such as less than 3 minutes. The rate of heating thus is able to be compatible with minimal exposure of the hot strip to contaminants, as well as practical hot rolling speeds. Also, it enables the volume of unit 20 to be kept relatively small, thereby minimising the volume of protective gas required and also minimising the rate at which titanium contaminating gases are introduced with that gas. A short spacing between furnace 22 and mill 24 reduces the opportunity for an excessive drop in strip temperature, such as to a level unsuitable for hot rolling, or the need for supplementary heating between those stations to prevent such a temperature drop.

In the course of being pre-heated in furnace 22 and passing to the rolls 32 at mill 24, the strip is strengthened by particle to particle fusion. However, the pre-heating preferably achieves little increase in sheet density, with any increase typically being less than about 7%, such as from 2% to 5%. However, at mill 24, the pre-heated strip 30 undergoes a defined percentage thickness reduction during hot densification, such as in achieving a density of at least about 98% of the theoretical value, preferably greater than 99% of that value. Thus, the hot rolling provides the predominant hot densification mechanism in that a major part, that is, in excess of 50% of hot densification in steps (a) and (b) of the invention is achieved by hot rolling. Preferably in excess of 60%, such as not less than 65%, of hot densification is achieved by hot rolling. Thus, densification occurring during pre-heating to enable hot rolling represents only a minor part of hot densification. The thickness reduction resulting from hot rolling may be from a thickness of 5 to 20 mm for green strip 18 to a thickness of 2 to 10 mm for hot rolled strip 34.

In passing beyond mill 24, the hot rolled strip 34 enters cooling unit 26. At the hot rolling mill 22, the strip undergoes a substantial reduction in temperature due to rolls 32 taking up heat energy from the strip, although the strip still is at a temperature at which it readily could be contaminated. The risk of contamination is reduced by the maintained protective atmosphere in unit 26. However, the risk is further reduced by the hot rolled strip being rapidly cooled to below about 400° C. by coolant fluid, preferably chilled water, circulated through the double-wall construction of unit 26. At practical speeds for hot rolling, cooled strip 36 at below 400° C. can be achieved in a cooling unit 26 of relatively short length, such as less than 2 m. The arrangement readily is able to be adapted to enable the cooled strip 36 to exit from housing 20 at practical hot rolling speeds at a temperature below about 100° C.

As indicated, a protective atmosphere at a slight overpressure is maintained in units 20 and 26, by the supply of protective gas (such as argon) through inlet connectors 46. While unit 20 is a heating unit and unit 26 is a cooling unit, they together function as a unitary housing in which steps (a) to (c) of the process of the invention are able to be conducted over a relatively short distance from the inlet to unit 20 to the outlet of unit 26. One factor which facilitates this is the effective cooling of the hot rolled strip able to be achieved in unit 26. This obviates the need for recourse to quenching, particularly as quenching as a practical matter is likely to necessitate exposure of the strip to the atmosphere. Also, quenching in water, or oxygen and/or water content of another quenchant, is likely to result in surface oxidation of the strip and, in the case of water, undesirable generation of hydrogen gas.

The cooled strip 36, on exiting from housing 20, is shown as passing to a strip coiling station 40 at which strip coil 42 is produced. However, as indicated, coiling is facilitated by limited cooling in unit 26. When coil 42 is of a required weight, strip 36 is severed and, after coil 42 is removed from station 40, coiling of strip 36 is recommenced. The removed coil may be cleaned before it is transferred to an annealing furnace and annealed for a suitable time such as, in the case of CP titanium, to achieve an equiaxed alpha phase microstructure before being cooled. After cooling the annealed strip preferably is subjected to at least one cold rolling stage, to achieve final gauge, surface appearance and mechanical properties. A predetermined cold rolled thickness reduction may be to a thickness of 0.1 to 5 mm and preferably less than 3 mm.

As indicated above, the powder feed to the rolls 16 of station 10 is shown in a highly stylised manner. A first part of a preferred arrangement is shown in FIGS. 2 to 5, while a further part is shown in FIG. 6. FIGS. 2 to 5 show a powder distribution device 50 for distributing powder to rolls 16. FIG. 6 shows a powder supply device 52 for supplying powder to the distributing device 50.

The powder distribution device 50 has an opposed pair of elongate support members 54 which are mountable on a support structure (not shown) to position device 50 above rolls 16 (see FIGS. 3 and 4). Each member 54 has an angle section bracket 56 secured to it, and the members 54 are held in space relationship by connectors 58 secured between the brackets 56. The members 54 extend at right angles to the axes of rolls 16, while connectors 58 are parallel to those axes, with there being one connector above each roll 16. The brackets 56 and connectors 58 border a rectangular opening 60 which is above the gap of the rolls 16 and through which powder is able to be supplied for consolidation between rolls 16.

Figure 5:
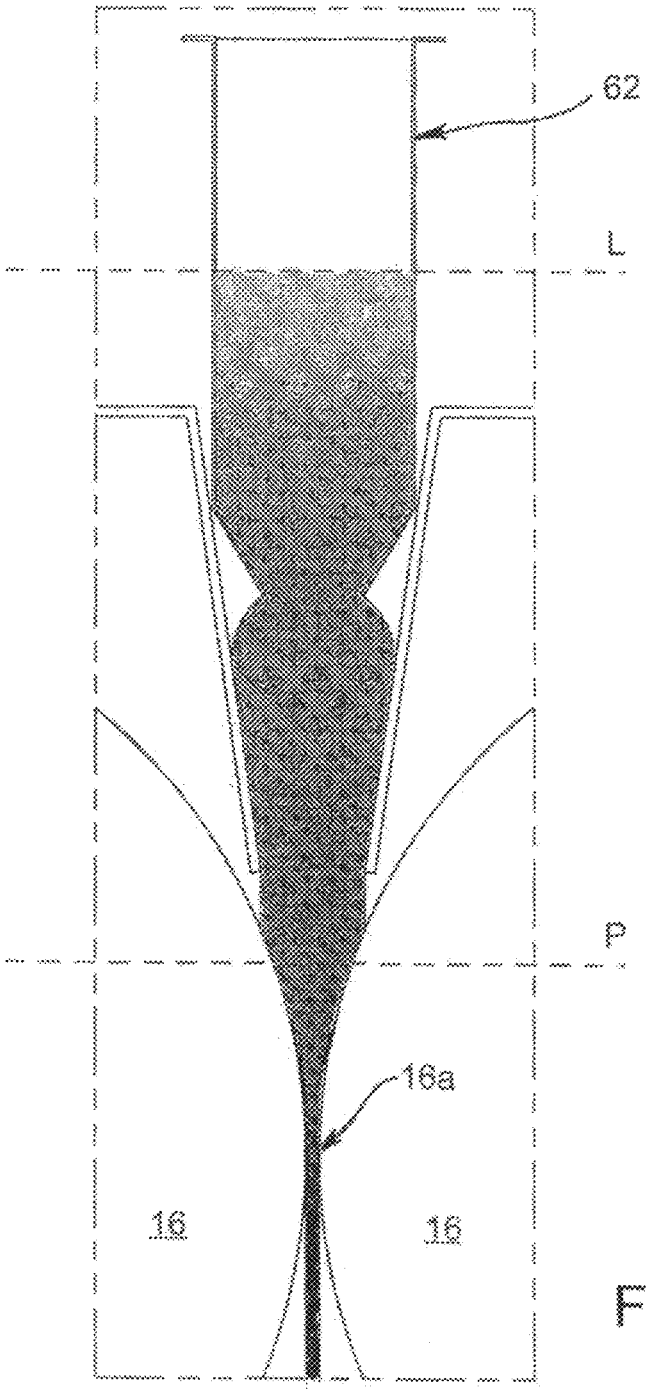
FIG. 5 shows, on an enlarged scale, detail from the section shown in FIG. 4.

An elongate powder distribution hopper 62 is mounted in opening 60, by a strap 64 at each end connected to a respective member 54. The hopper 62 is directly over the gap of rolls 16 and has its longitudinal extent parallel to the axes of the rolls. The hopper 62 has opposed side walls 66 which, apart from lower margins 66*a*, are parallel and vertically disposed over a main part of the height of hopper 62. Hopper 62 also has end walls 67 which are inclined so that hopper 62 decreases in horizontal cross-section from its top to its bottom. At its bottom, hopper 62 has an elongate outlet slot 68 defined by walls 66 and 67. As can be seen in FIGS. 3 to 5, the lower margin 66*a* of each side wall 66 is inclined inwardly towards the opposite side wall 66.

The lower extent of hopper 62 is disposed between an opposed pair of guide plates 70 which define a powder guide. The guide plates 70 are inclined towards each other and the part of hopper 62 therebetween. At its upper end, each plate 70 has an out-turned flange 70*a* by which it is secured to a respective connector 58. The inclination of guide plates 70 and of the margin 66*a* of side walls 66, as well as the width of margins 66*a* and the positioning of the lower edges of walls 66 and plates 70 are parameters used in achieving controlled flow of powder from hopper 62 to the gap of rolls 16.

In the enlarged detail of FIG. 5, the hopper 62 guide plates 70 and rolls 16 are shown in relation to a column 72 of powder maintained above the gap 16*a* of rolls 16. The column 72 extends from a level L substantially at which powder is maintained by powder feed to hopper 62 during the direct powder rolling by rolls 16 to produce green strip. The powder column 72 is constricted by the taper of margins 66*a* of hopper side walls 66 and this assists in forcing out some of the air entrained between powder particles. Just below outlet slot 68 defined at the lower edge of side walls 66, the powder column expands slightly to contact guide plates 70 and this, in combination with the inclination of plates 70, assists with a further release of entrained air through a slight air gap 74 between each plate 70 and the adjacent wall 66. Adjacent to the lower edge of guide plates 70, the powder column 72 contacts the surface of rolls 16. The arrangement is such that the contact occurs just above a level P at which the pinching of powder by rolls 16 commences. That is, above level P, the rolls 16 simply bring powder particles of powder column 72 into closer contact, substantially without pinching, while below level P pinching progressively increases to initiate powder consolidation which is completed at the gap 16*a* of rolls 16.

When appropriately angled, the margins 66*a* of hopper side walls 66 and the guide plates 10 progressively compress the powder particles of the column 72. Also, they retard the flow of powder towards the gap 16*a* of rolls 16. In doing this, margins 66*a* and guide plates 70 are able to meter the flow of powder to the gap 16*a* substantially at a rate matching the surface speed of rolls 16. The rolls 16 have the same diameter and are driven at the same surface speed.

The level P, in one trial apparatus, using rolls of about 150 mm diameter, corresponds to a pinch angle θ of about 15° C., and a height of level P above the gap 16*a* of about 20 mm. The suitable width of hopper outlet slot 68 is substantially the same as the width of column 72 at level P and measured about 8 mm. Above margins 66*a*, hopper 62 had a width of about 13.5 mm, while each of margins 66*a* was inclined to a vertical plane through gap 16*a* at an angle of about 24° C., to give an included angle of about 48° between margins 66*a*. The guide plates 70 were at an angle of about 8° to that plane, giving an included angle of about 16° between them. The lower edge of each guide plate 70 was spaced slightly above the level P by 2 to 3 mm, while there was an air gap of about 1.5 mm between each hopper side plate 64 and the adjacent guide plate 70, at the upper edge of each margin 66*a*. As indicated, the height of level P above the gap of rolls 16 was about 20 mm, while the height of level L above the rolls gap, that is, the overall height of column 72, was about 130 mm. The hopper 62 and guide plates were made of stainless steel.

Trial apparatus as described was used with the powder supply device of FIG. 6 and rolls as shown in FIG. 7. The trial apparatus was supplied with titanium powder of minus #100 mesh. The powder was supplied at a rate substantially maintaining level L of the powder 130 mm above the roll gap, and smooth continuous flow of powder to the gap of rolls 16 was achieved. Resultant green strip produced had a width of 100 mm and was able to be varied in thickness, with variation in roll speed, between about 1.5 mm to about 1.0 mm. The green strip was self-supporting and bendable, with a density varying from about 65% to 85% of the theoretical value, most frequently between about 75% to about 85%.

The trial apparatus included a consolidation unit which substantially corresponded to unit 20 of FIG. 1. In the following, the consolidation unit of the trial apparatus is described with use of the reference numerals of FIG. 1. The unit 20 had a furnace 22 which was 1300 mm long, 800 mm wide and 1200 mm high. The unit 20 was joined to a cooling unit 26 which was 1000 mm long, 360 mm wide and 130 mm high.

Within the unit 20 the pre-heating furnace 22 comprised a 250 kW, 25 kHz induction heating system. The furnace 22 was operable to heat green strip 18 predominantly by radiation, due to the system being based on induction heating via water cooled copper coils in a rectangular graphite susceptor through which the green strip 18 passed. The susceptor 28 was 1200 mm long, 450 mm wide and 120 mm high, with a wall thickness of 25 mm. During operation of the furnace 22, a water flow rate through the copper coils of the graphite susceptor 28 was maintained at about 32 L/m.

The hot rolling mill 24 included a pair of rolls 32 of 150 mm diameter. The distance from the outlet of furnace 22 to the nip point of rolls 32 was approximately 150 mm.

During operation of unit 20, argon was supplied through two main inlet ports adjacent to the furnace 22, at an average overall flow rate of about 10 sL/min. Argon also was supplied at the same overall flow rate through three ports adjacent to rolls 32. The argon supplied to rolls 32 and to furnace 22 maintained a slight positive pressure in its flow through unit 20 in the opposite direction to the direction of movement of strip 18.

The cooling unit 26 was of a jacketed water cooled construction. During the passage of hot rolled strip 34 through unit 26, it was protected by argon supplied normal to the face of strip 34 through three ports spaced along the length of unit 26. The argon was supplied at an aggregate flow rate of about 10 sL/min. A proportion of the argon supplied to unit 26 flowed into unit 20, but the main portion flowed in the direction of advance of strip 34.

Cooling water, preferably chilled, was supplied to cooling unit 26 at a pressure of about 220 kPa. For green strip 1.4 mm thick and 100 mm wide, hot rolled at about 800° C. (after preheating at a set temperature of 1350° C. for furnace 28) to a thickness of about 1 mm, the strip was able to be cooled in housing part 26 to a surface temperature of about 90° C. During this operation, the supply of argon was able to maintain essentially zero oxygen content in the housing 20.

The trial apparatus enabled the production of high density titanium strip of good quality and properties. The apparatus enable strip densities close to the theoretical density.

FIG. 6 shows a powder supply device 52 as mounted above the powder distribution device 50. The device 52 has a hopper 76, and an elongate, channel-form vibro feeder 77. The device 52 is shown as mounted above device 50, such as by securement to the same support structure (not shown) as used for device 50. The hopper 76, which has a large capacity relative to hopper 62 of device 50, is mounted over an inlet end of feeder 77. The feeder 77 extends along the line of strip advance from station 12 to housing 20 (in this instance such that powder advances along feed 77 in the opposite direction to strip advance). The outlet end of feeder 77 is located just above hopper 62 of device 50.

Powder is supplied to hopper 76, preferably after it has been pre-treated to enhance its flow properties, such as by being heated to a temperature of from 40° C. to 80° C. for a time sufficient to remove substantially all moisture content. At its lower end, hopper 76 has an adjustable metering outlet enabling variation in the rate at which powder is released into feeder 77. Vibration of feeder 77 advances the powder to the outlet end for release at a required rate into hopper 62. A mesh 78 is provided over the top of hopper 76 and serves to break up or retain agglomerated powder particles. Also, in feeder 77, at least one gate 79 is provided. The lower edge 79*a* of gate 79 is spaced a short distance above the base of feeder 77 and thereby also serves to break-up or retain any agglomerated powder particles.

The arrangement of, and control provided by, device 52 enables powder to be supplied to distribution device 50. In combination with the control provided by device 50, device 52 facilitates the feeding of powder to the gap of rolls 16 in a smooth, continuous flow at a substantially constant rate.

EXAMPLE 1

In a first trial illustrating the invention a hydride/dehydride derived grade 3 titanium powder with an oxygen content of 0.32 to 0.35% and a particle size nominally less than 150 microns was direct rolled into green sheet. The resultant density was 81% of theoretical and the thickness and width was 1.2 mm and 100 mm respectively. The green sheet was passed twice through a chamber at an environment temperature of 1200° C. in which it was hot rolled at a speed of 4 m/min before being cooled to ambient temperature. Throughout heating, hot rolling and cooling, the sheet was protected by an argon atmosphere supplied at a slight overpressure. The first hot roll pass was at a reduction of 35% and the second pass at 15% resulting in a combined percentage thickness reduction of 50%. The subsequent hot rolled sheet had a density of greater than 99.9% theoretical. After mill annealing at 750° C. for 30 minutes, subsequent mechanical testing resulted in elongations of 16 to 18%, an ultimate tensile strength of 750 MPa and a 0.2% proof (yield) strength of 670 MPa. The chemistry of the annealed sheet conformed to ASM grade 3 titanium sheet.

EXAMPLE 2

In a second trial illustrating the invention, titanium powder (oxygen at 0.10 to 0.13%, Cl at about 1000 ppm) manufactured using a sodium reduction process with a particle size nominally less than 150 microns was direct rolled into 1.0 mm thick green sheet. The resultant density was 89% of theoretical. While protected by an argon atmosphere at a slight overpressure, the green sheet was passed twice through a chamber at an environment temperature of 1200° C. in which it was hot rolled at a speed of 6 m/min, before being cooled in that protective atmosphere to ambient temperature. The first hot roll pass was at a reduction of 43% and the second pass at 16% resulting in a combined percentage thickness reduction of 59%. The subsequent hot rolled sheet had a density of greater than 99.5% theoretical. After mill annealing at 750° C. for 30 minutes, subsequent mechanical testing resulted in elongations of 16 to 18% and an ultimate tensile strength of 525 MPa.

The powder may be any of a wide range of titanium containing powders. Thus, the powder may be CP titanium or a suitable titanium alloy. Alternatively, the powder may be a blend of at least two different materials. In the latter case, the materials may differ in physical form and/or compositionally, such as in being a blend of CP titanium or titanium alloy powder with powder of alloying elements or of another titanium alloy, or such as an inter-metallic compound. As indicated, the powders may be of a composition which, in a wrought product, would exhibit segregation.

FIG. 7 shows a preferred profiled form for the rolls 16 used at station 12. As shown, the rolls are of complementary form. One roll 80 has smaller diameter mid-portion 80*a* which separates respective larger diameter end portions 80*b*, while the other roll 81 has a larger diameter mid-portion 81*a* which separates smaller diameter end portions 81*b*. In each of rolls 80 and 81, the successive portions merge at inclined, annular shoulders 80*c* and 81*c*, respectively. Powder compaction is achieved between the respective mid-portions 80*a* and 81*a*, while co-operating respective shoulders 80*c* and 81*c* at each end of the mid-portions, limit the movement of powder beyond the mid-portion ends and facilitate the production of green strip which has a width substantially corresponding to the length of the mid-portions 80*a* and 81*a* and which exhibits substantially uniform densification across its width.

Finally, it is to be understood that various alterations, modifications and/or additions may be introduced into the constructions and arrangements of parts previously described without departing from the spirit or ambit of the invention.

The claims defining the invention are as follows:

1. A continuous process for producing titanium strip material consisting essentially of a continuous sequence of the steps of:

(a) continuously passing a supply of powder consisting essentially of titanium powder to a roll compaction station and subjecting the powder to direct powder rolling in the roll compaction station to thereby consolidate the powder and form self-supporting titanium powder green strip which issues from the compaction station, (b) continuously passing the titanium powder green strip of step (a) as it is produced and issues from the compaction station to and through a heating station in which the titanium powder green strip is heated under a protective atmosphere, as it passes through the heating station, to a temperature at least sufficient for hot rolling, (c) passing pre-heated strip of step (b) from the pre-heating station to and through a rolling station while still under the protective atmosphere and hot rolling the pre-heated strip to produce a hot rolled strip of a required level of hot densification; and (d) passing the hot rolled strip of step (c) from the hot rolling station, to and through a cooling station adapted to provide cooling of the hot rolled strip, while still under the protective atmosphere, and cooling the hot rolled strip to a temperature at which it can be passed out of the protective atmosphere;

wherein hot rolling in step (c) provides the predominant hot densification mechanism involved in the process, the strip is at an elevated temperature during steps (b) and (c) for a period of time which is less than 5 minutes, wherein the pre-heating, hot rolling and cooling stations are spaced within a single housing throughout which the protective atmosphere for each of steps (b), (c) and (d) is maintained by supplying protective gas to the housing to maintain an over-pressure in the housing, and wherein the housing has a first part in which the preheating and hot rolling stations are contained, and a second part defining or containing the cooling station.

2. The process of claim 1, wherein the period of time is less than 2 minutes.

3. The process of claim 1, wherein the strip is moved through the successive stations by being drawn by rolls by which the hot rolling of step (c) is performed.

4. The process of claim 3, wherein the titanium powder is pre-treated, prior to forming the green strip, to improve the flow characteristics of the powder.

5. The process of claim 4, wherein the powder is pre-treated before step (a) by heating to a temperature of from 40° C. to 80° C. for a period of time sufficient to remove substantially all moisture.

6. The process of claim 1, wherein the protective gas is supplied to generate a counter-current flow of gas, with respect to the direction of the strip, in the pre-heating and hot rolling stations, and a co-current flow of gas with respect to that direction, in the cooling station.

7. The process of claim 1, wherein the green strip is preheated in step (b) to a temperature enabling the strip to reach the rolls for hot rolling in step (c) at a temperature in the range of from 750° C. to 1350° C.

8. The process of claim 7, wherein the preheated strip is hot rolled in step (c) at a temperature close to or above the $\alpha$ to $\beta$ transus temperature.

9. The process of claim 7, wherein the pre-heated strip is hot rolled in step (c) at a temperature of from 800° C. to 1000° C.

10. The process of claim 1, wherein the green strip has a density of from 65% to 85% of the theoretical value.

11. The process of claim 1, wherein the extent of any densification resulting from the pre-heating of step (b), prior to the commencement of step (c) is substantially less than 10%.

12. The process of claim 11, wherein the densification resulting from step (b) is from 2% to less than 7%.

13. The process of claim 1, wherein the hot rolled strip produced by step (c) has a density of at least 98% of the theoretical value.

14. The process of claim 13, wherein the hot rolled strip produced by step (c) has a density of at least 99% of the theoretical value.

15. The process of claim 1, wherein the second part of the housing is of a double-walled construction and the hot rolled strip is cooled by circulating coolant through the construction.

16. The process of claim 1, wherein the hot rolled strip is cooled in step (d) to a temperature below 400° C. prior to it being passed out of the protective atmosphere.

17. The process of claim 16, wherein the cooling in step (d) prior to the hot rolled strip being passed out of the protective atmosphere is to a temperature below 100° C.

18. The process of claim 1, wherein the hot rolled strip is cooled in step (d) to a temperature of from 150° C. to 400° C. prior to it being passed out of the protective atmosphere.

* * * * *